US012492599B2

(12) United States Patent
Bresnehan

(10) Patent No.: US 12,492,599 B2
(45) Date of Patent: Dec. 9, 2025

(54) METHOD AND APPARATUS FOR ASSISTING IN EXTRACTION OF FLUID FROM COAL-SEAMS

(71) Applicant: CFT Technologies Pty Ltd, Moorabbin Vic (AU)

(72) Inventor: Rodney Michael Bresnehan, Moorabbin Vic (AU)

(73) Assignee: CFT TECHNOLOGIES PTY LTD, Moorabbin Vic (AU)

( * ) Notice: Subject to any disclaimer, the term of this patent is extended or adjusted under 35 U.S.C. 154(b) by 0 days.

(21) Appl. No.: 18/024,291

(22) PCT Filed: Sep. 3, 2021

(86) PCT No.: PCT/AU2021/051026
§ 371 (c)(1),
(2) Date: Mar. 2, 2023

(87) PCT Pub. No.: WO2022/047542
PCT Pub. Date: Mar. 10, 2022

(65) Prior Publication Data

US 2023/0349237 A1 Nov. 2, 2023

(30) Foreign Application Priority Data

Sep. 3, 2020 (AU) ..... 2020903158

(51) Int. Cl.
*E21B 7/18* (2006.01)
*E21B 41/00* (2006.01)
(Continued)

(52) U.S. Cl.
CPC ..... *E21B 7/18* (2013.01); *E21B 41/0078* (2013.01); *E21B 43/305* (2013.01); *E21B 7/065* (2013.01); *E21B 43/006* (2013.01)

(58) Field of Classification Search
CPC ..... E21B 7/18; E21B 41/0078; E21B 43/305; E21B 7/065; E21B 43/006; E21B 10/60;
(Continued)

(56) References Cited

U.S. PATENT DOCUMENTS

2001/0045302 A1 11/2001 Mazorow
2002/0011357 A1 1/2002 Trueman et al.
(Continued)

FOREIGN PATENT DOCUMENTS

WO 2019/140287 7/2019

OTHER PUBLICATIONS

European Search Report dated Aug. 30, 2024, issued in corresponding PCT/AU2021051026, (pp. 1-9).

*Primary Examiner* — Nicole Coy
*Assistant Examiner* — Jennifer A Railey
(74) *Attorney, Agent, or Firm* — Millen, White, Zelano & Branigan, P.C.; Christopher W. Brody

(57) ABSTRACT

An apparatus or combination of operational equipment for effecting liquid or gas communication to, from or between at least one gas and/or liquid containing source. The at least one source having an upper boundary through which an access well is drilled. The access well extending downwardly to a location within the reservoir. The access well also drilled laterally within the at least one source. The upper boundary being a transition in phase or composition of solids, liquids or gases underground such as a transition between clay and shale. The apparatus or combination of operational equipment including a jetting device for insertion into the access well. The jetting device adapted to jet multiple boreholes from a lateral portion of the access well at multiple radial orientations around the lateral portion relative to a vertical.

14 Claims, 5 Drawing Sheets

(51) Int. Cl.

| | |
|---|---|
| ***E21B 43/30*** | (2006.01) |
| *E21B 7/06* | (2006.01) |
| *E21B 43/00* | (2006.01) |

(58) Field of Classification Search

CPC ..... E21B 43/00; E21B 43/114; E21B 7/046; E21B 43/14; E21B 10/61; E21B 41/0035; E21B 43/162; E21B 43/166; E21C 41/24; E21C 45/00

See application file for complete search history.

(56) References Cited

U.S. PATENT DOCUMENTS

| | | | | |
|---|---|---|---|---|
| 2009/0101414 | A1 | 4/2009 | Brunet et al. | |
| 2009/0107678 | A1 | 4/2009 | Buckman, Sr. | |
| 2009/0218143 | A1* | 9/2009 | Sanfelice | E21B 7/18 175/77 |
| 2010/0181113 | A1* | 7/2010 | Watson | E21B 43/305 175/62 |
| 2012/0037372 | A1 | 2/2012 | Foundas et al. | |
| 2016/0348439 | A1* | 12/2016 | Wang | E21B 7/065 |
| 2019/0153841 | A1* | 5/2019 | Randall | E21B 7/061 |
| 2019/0226282 | A1 | 7/2019 | Potapenko et al. | |

* cited by examiner

METHOD AND APPARATUS FOR ASSISTING IN EXTRACTION OF FLUID FROM COAL-SEAMS

FIELD OF INVENTION

This invention relates to a method and apparatus for extracting fluid from coal-seams. More particularly, this invention relates to a method and apparatus for extracting fluid from coal-seams involving an improved communication to, from and/or between underground gas or liquid sources. Most particularly, this invention relates to a method and apparatus for extracting fluid from coal-seams involving improved fluid communication to, from and/or between underground fluid reservoirs and coal-seams without fracture stimulation of the strata.

BACKGROUND ART

The following references to and descriptions of prior proposals or products are not intended to be, and are not to be construed as, statements or admissions of common general knowledge in the art. In particular, the following prior art discussion should not be assumed to relate to what is commonly or well known by the person skilled in the art, but to assist in the inventive process undertaken by the inventor (s) and in the understanding of the invention.

Methods have been described involving drilling a bore into a coal seam to extract coalbed methane (CBM). A problem with this approach is that the coal seam may be soft and there is a risk of it collapsing on itself. This can make the material difficult to bore. Problems are often encountered in attempting to drill significant distances because of the tendency for the material to collapse.

Therefore, there is a need for an alternative method for recovering gas and/or liquids, such as CBM and other hydrocarbons, from gas and/or liquid reservoirs, especially soft geological materials such as coal, shale or sand.

Prior art attempts may involve environmentally unpalatable fracking. There is consumer, governmental and industry motivation and pressure to promote sustainable coal-seam gas extraction.

An object of the present invention is to ameliorate one or more of the aforementioned disadvantages of the prior art or to at least provide a useful alternative thereto.

STATEMENT OF INVENTION

The invention according to one or more aspects may be as defined in the independent claims. Some optional and/or preferred features of the invention are defined in the dependent claims.

Accordingly, in one aspect of the invention there is provided:

An apparatus, optionally including a combination of operational equipment, for effecting liquid or gas communication to, from or between strata comprising at least one gas and/or liquid containing source, the at least one source having an upper boundary through which an access well and/or boreholes are drilled whereby to extend the access well downwardly to a location within, above and/or below the at least one source, and to drill the access well laterally within, above and/or below the at least one source, the apparatus including a jetting device that is adapted to be inserted into the access well and characterised in that:

the jetting device is adapted to form multiple boreholes extending from a lateral portion of the access well which are in multiple substantially radial orientations about the lateral portion without fracture stimulation of the strata.

In another aspect of the invention, there is provided:

A drilling method for extracting coalbed methane (CBM) including deploying an apparatus, optionally including a combination comprising two or more components of operational equipment, to effect fluid communication to, from or between strata comprising at least one gas and/or liquid containing source having a boundary, wherein the method steps include drilling an access well whereby to extend it to a location within or above the at least one source, characterised in that the method further includes:

drilling laterally within the at least one source to form a lateral portion of the access well; and using a jetting device that is adapted to be inserted into the access well to form at least one channel extending outwardly from the lateral portion without fracture stimulation of the strata.

The method may include the step of using a horizontal well for jetting purposes.

The method may include the step of using a lateral well drilled above the coal seam.

The method may include the step of using a lateral well drilled through the coal seam.

The method may include the step of using a lateral well drilled between multiple coal seams.

The method may include the step of using a lateral well drilled through multiple coal seams.

The method may include the step of using a lateral well below the coal seam.

The method may include the step of using a lateral well drilled "within" a shale reservoir.

Boundary

The upper boundary may be a transition in phase or composition of solids, liquids or gases underground such as a transition between clay and shale. The at least one reservoir may include a lower boundary located underneath or deeper underground than the upper boundary. In this specification, the terms "upper boundary" and "lower boundary" will be referred to as "boundaries".

The boundaries may be consolidated boundaries having clear outer margins. The boundary may be a definite or clear boundary.

The boundaries may include a transition between geological substrates such as clay, shale, rock, loam, sand, sandstone and/or other naturally occurring underground solids, liquids or gasses. The boundaries may include a transition between rock, sandstone or clay and a methane reservoir.

Gas and/or Liquid Containing Source

The at least one gas and/or liquid containing source may include at least one reservoir.

The at least one gas and/or liquid containing source may include multiple small pockets of liquid or gas. The at least one gas and/or liquid containing source may include liquid or gas permeated through a geological solid. The at least one gas or liquid containing source may include multiple small pockets of liquid and/or gas spread throughout a geological substrate in a swiss cheese or sponge pattern. The at least one gas or liquid containing source may include methane in shale or a coal seam. The liquid and/or gas of the liquid and/or gas containing source may include crude oil or methane.

Access Well

The access well may be drilled using a bore drill with a head adapted to physically crush, cut and/or remove material from the access well. The bore drill may include a water jet to crush, cut and/or remove material from the access well. The access well may be between 10 m and 1000 m deep. The access well may be up to 15 km long in the lateral direction. The access well may be up to 10 km long in the lateral direction. In this specification, a "lateral direction" or a "lateral portion" refers to a direction or a portion having a vector component that is parallel to a ground surface, or transverse or perpendicular to the direction of the force of earth's gravity.

The access well may be adapted to drill laterally through the liquid and/or gas containing source. The access well may be adapted to drill laterally through multiple liquid and/or gas containing sources. The access well may be adapted to drill laterally above the liquid and/or gas source. The access well may be adapted to drill laterally below the liquid and/or gas source.

Jetting Device

The jetting device may include a coil, tube or pipe adapted to extend from the ground surface to a nozzle head of the jetting device. The coil may be adapted to supply liquid or gas to the nozzle head of the jetting device. The coil may be adapted to provide tension between the nozzle head and other components about the ground surface.

The nozzle head may be adapted to jet liquid or gas at multiple angles from the nozzle head. The nozzle head may be adapted to jet liquid or gas both in forward and reverse directions along the access well. The nozzle head may be adapted to propel the nozzle head and jetting device forward and/or backwards along the access well. The nozzle head may include nozzles adapted to erode channels at an angle between 1° and 90° from a longitudinal axis of the access well. The nozzle head may include nozzles adapted to erode channels at the angle, wherein the angle is between 30° and 60° from the longitudinal axis of the access well. Preferably, the nozzle head includes nozzles adapted to erode channels at the angle, wherein the angle is between 40° and 50° from the longitudinal axis of the access well.

Preferably, the nozzle head is adapted to jet water from the nozzle head. Preferably, the nozzle head is adapted to jet water out of the nozzles. Most preferably, the nozzles are adapted and orientated to both jet water to erode channels and propel the nozzle head along the access well.

The jetting device may be adapted to jet bore holes downwardly and/or upwardly relative to a nominally horizontal longitudinal axis of the nozzle). The jetting device may be adapted to jet bore holes at an angle having a range of 360° rotationally around or radially outwardly into and through the access well wall.

The jetting device may be adapted to jet bore holes up to 100 m (metres) from the access well. Preferably, the jetting device is adapted to jet boreholes up to 50 m from the access well.

The jetting device may be adapted to jet bore holes at intervals along the access well.

The jetting device may be adapted to jet boreholes at regular intervals along the access well.

The jetting device is preferably adapted to create the multiple radial boreholes without fracture stimulation of the strata. The jetting device is preferably adapted to create the multiple substantially radial boreholes without fracking damage to the strata containing the at least one source or reservoir.

Preferably, the apparatus further includes a diverter or deflector that is adapted to redirect, divert or deflect fluid jetted from the nozzle head at the angle. The diverter may comprise one or more deflectors to redirect jetted fluid in the desired direction to achieve erosion of earth material and each one of the boreholes.

The diverter may include an in-built rotation system.

The diverter may form part of a diverter system including a remote control facility. The diverter system may be adapted to allow for control at ground level or otherwise for remote control.

The diverter system may include sensors. The sensors may facilitate responsively controlled jetting of the nozzle head.

The diverter system may include a diverting device. The diverting device may be adapted to change the angle of a jetting tubing exit. The angle may be between 0-90, more preferably 30-60, still more preferably 40-50, and ideally 45 degrees.

The jetting device may include jetting tubing to effect the jet stream. The jetting tubing may be in the form of capillaries. The jetting device may include capillary tubing.

Preferably, the jetting tubing includes stainless steel capillary tubing.

The tubing may be directed into the strata formation through the diverting device. This may be for a distance of the order of 10 m-200 m, and preferably a distance of 20 to 100 metres. The substantially radially extending boreholes may be formed at intervals in a 360 degree orientation from the horizontal wellbore. The jetting device operates at selected intervals along part of or an entire length of the horizontal wellbore. In considering the term "substantially radially" extending boreholes, the term is considered to include within its scope a borehole with a vector component having a radial direction relative to the lateral portion, so that the borehole may extend at an angle to a radial direction extending perpendicular from the lateral portion.

It will be appreciated that any of the features described herein can be used in any combination, and that the invention as described in respect of the second aspect may have the specific features referred to above in respect of the invention as described in respect of the first aspect.

BRIEF DESCRIPTION OF THE DRAWINGS

The invention may be better understood from the following non-limiting description of preferred embodiments, in which.

DETAILED DESCRIPTION OF THE DRAWINGS

Figure 1:
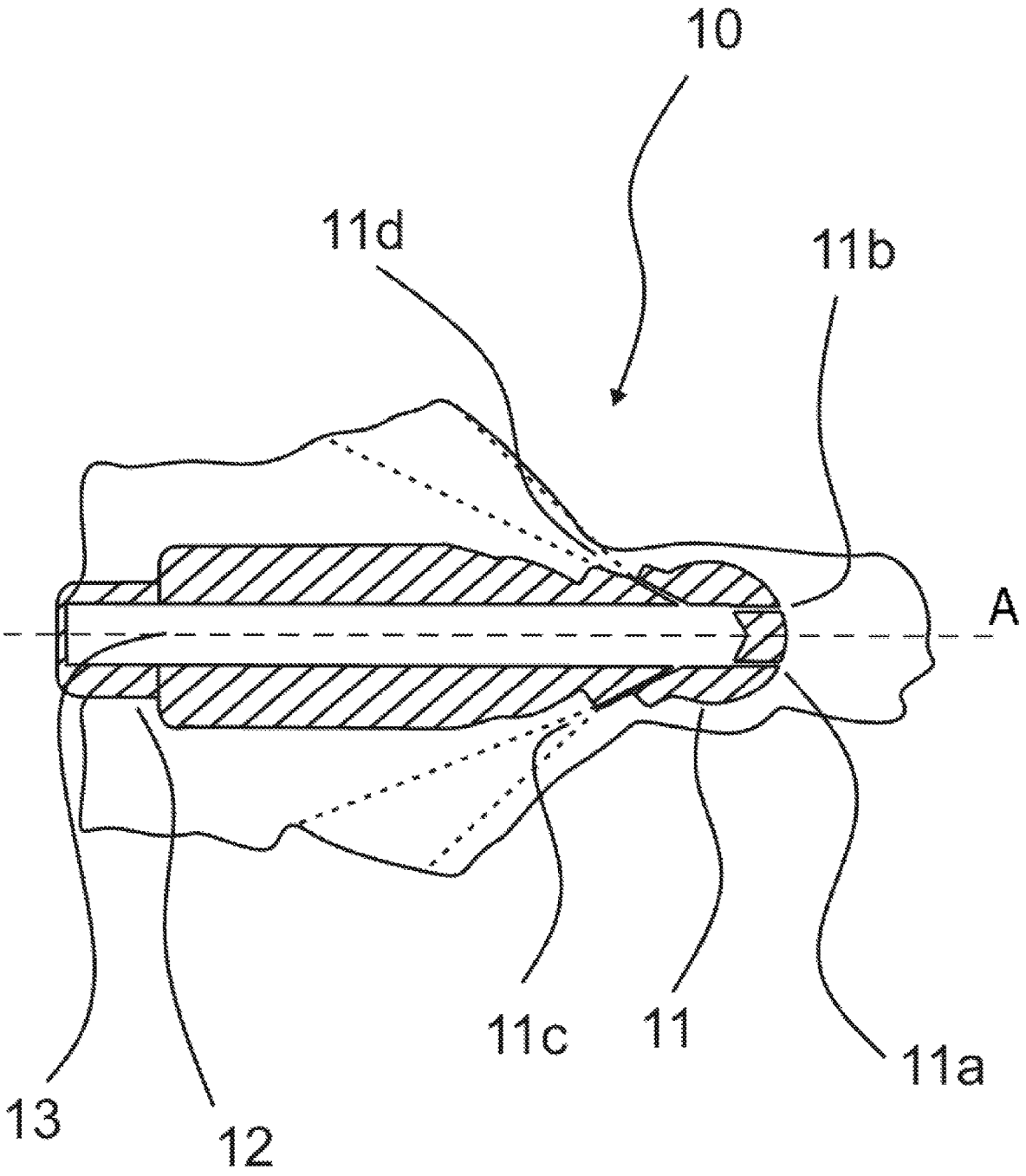
FIG. 1 is a cross sectional view of a nozzle head of a jetting device of an apparatus or combination of operational equipment jetting water in an access well.

Preferred features of the present invention will now be described with particular reference to the accompanying drawings. However, it is to be understood that the features illustrated in and described with reference to the drawings are not to be construed as limiting on the scope of the invention. In describing the various embodiments of the invention, like features will be referred to using like references, with references for features of each embodiment generally preceded by 1, 2, 3, or followed by a Roman numeric sequence, such as i, ii, iii, etc. or an alphabetical sequence such as a, b, c, relative to the corresponding feature of the first embodiment. For example, a feature 10 of the first embodiment may represented as 110, 210, 310, (or n10), or 10*a*, 10*b*, 10*c*, (or 10*x*) or 10*i*, 10*ii*, 10*iii*, (or 10*r*) etc. in second, third and fourth embodiments, respectively.

An apparatus or combination of operational equipment 1 for effecting liquid or gas communication to, from or between at least one gas and/or liquid containing source 3*a,b* forming part of a strata. The at least one source 3*a,b* having an upper boundary 5 through which an access well 20 is drilled. The access well 20 extending downwardly to a location within the reservoir 3*a,b*. The access well 20 also drilled laterally within the at least one source 3*a,b*. The upper boundary 5 being a transition 5 in phase or composition of solids, liquids or gases underground such as a transition between clay 7 and shale 9. The apparatus or combination of operational equipment 1 including a jetting device 10 for insertion into the access well 20. The jetting device 10 adapted to jet multiple boreholes 22 from a lateral portion 21*a* of the access well at multiple radial orientations 23 around the lateral portion 21*a* relative to a vertical. The jetting device 10 is adapted to avoid fracking or fracture stimulation of the strata.

Figure 5A:
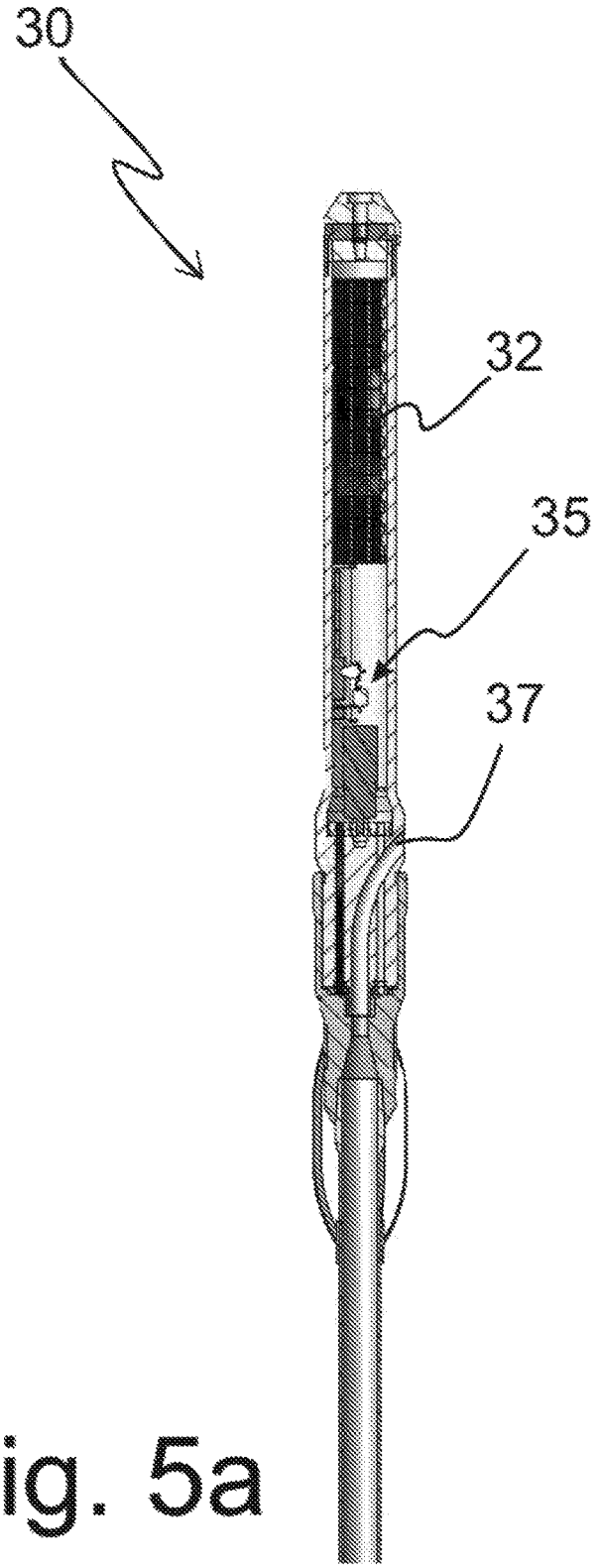
FIG. 5*a* is a front cross sectional view of a bore drill.
Figure 5B:
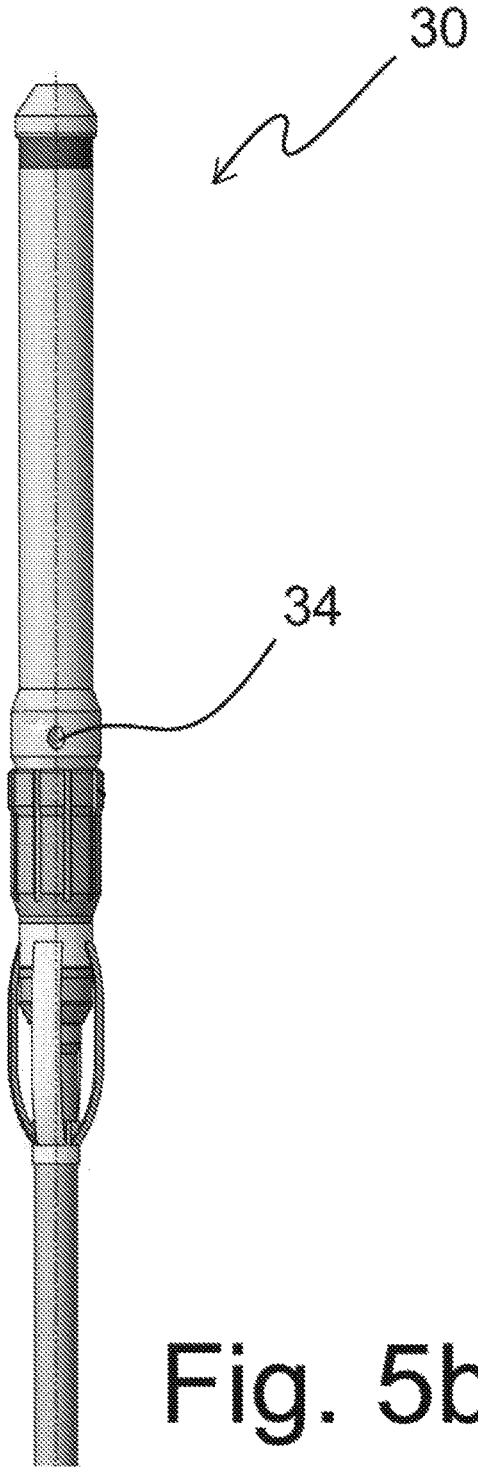
FIG. 5*b* is a right side view of the bore drill.

The apparatus or combination of operational equipment 1 includes a bore drill. A method of using the apparatus or combination of operational equipment 1 to extract methane from natural underground methane sources 3*a,b* such as in shale includes the following. The apparatus or combination of operational equipment 1 drilling the access well 20 vertically downwards underground into or at the depth of the methane source 3*a,b*. The access well may also be drilled in a direction with horizontal vectors but preferably vertically to ensure the path of the access well to the underground methane sources 3*a,b*. In FIGS. 5*a-b*, a nozzle 11 for a bore drill 30 that is suitable for use according to the invention is shown. In FIG. 1, a nominally horizontal longitudinal axis A of the nozzle 11 is shown.

The bore drill 30 is adapted to rotate at least one jet 37 to change or maintain the direction that the bore drill 30 is moving in as it is drilling the access well.

The bore drill 30 is adapted to be remotely controlled via the surface or above ground. The bore drill includes batteries 32 to power the componentry, the rotation and general operation of the bore drill 30. The bore drill 30 may include sensors 35 such as accelerometers, elevation sensors (adapted to measure depth) and electronic gyroscopes. The bore drill 30 further includes a drilling jet 34 adapted to drill the access well 20.

Figure 2:
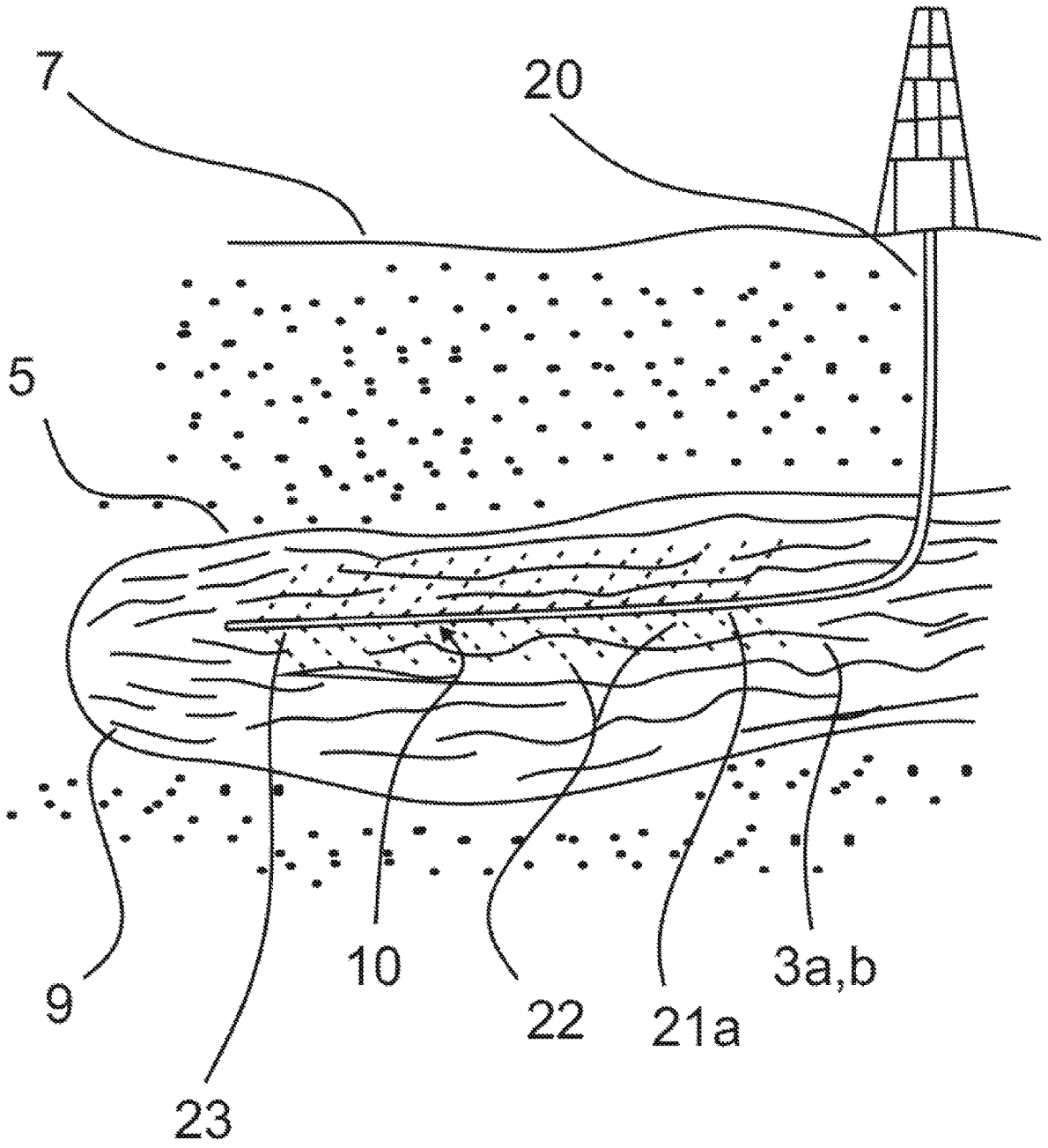
FIG. 2 is a cross-sectional view of the access well underground going through a liquid and/or gas reservoir.
Figure 3:
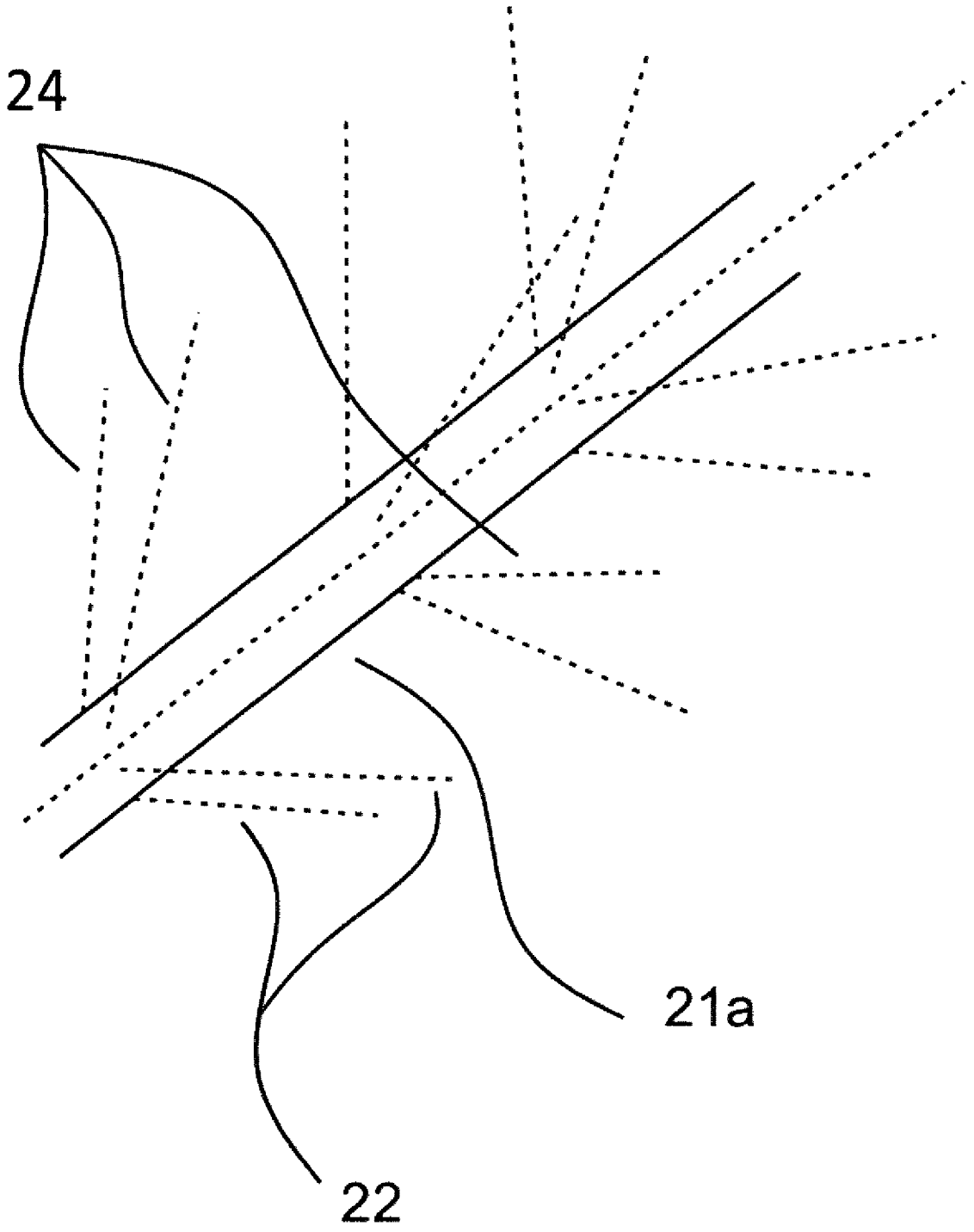
FIG. 3 is a cross-sectional view of the access well underground going through multiple liquid and/or gas reservoirs.
Figure 4:
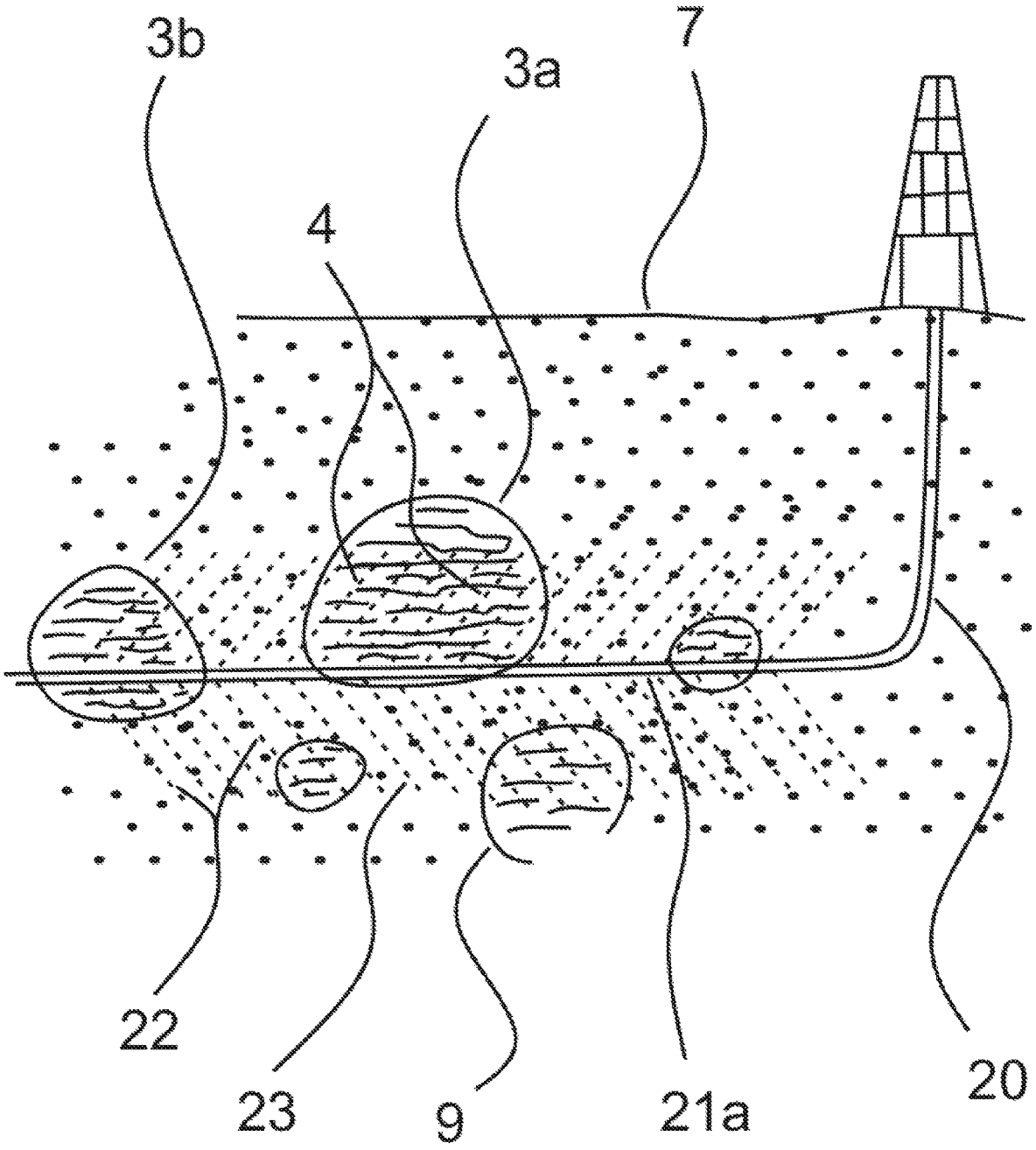
FIG. 4 is a perspective view of a lateral portion of the access well with multiple boreholes shown in dotted lines.

After drilling vertically downwards with the bore drill 30, the bore drill then drills laterally through the underground methane source 3*a* (as shown in FIG. 2) or through a region containing multiple underground methane sources 3*b* (as shown in FIG. 3). After the access well 20 is drilled, the jetting device 10 is inserted into the access well 20. The jetting device 10 includes a nozzle head 11 attached to a tube 12. The jetting device 10 further includes a coil 13 which runs between above ground and the nozzle head 11. The coil 13 runs through the tube 12. The coil 13 acts as a spring and applies a force in the backwards direction along the access well 20 towards the ground surface 7 or open end of the access well 20.

The tube 12 supplies water to the nozzle head 11 through a pump system including a pump above or near the ground surface 7. The nozzle head 11 includes nozzles 11*a-d*. The nozzle head 11 includes at least 2 nozzles, preferably at least 4 nozzles 11*a-d*.

The nozzles 11*a-d* include borehole nozzles 11*a-d*. The borehole nozzles 11*a-d* face laterally from a longitudinal line 23 along the access well 20. The boreholes 11*a-d* are orientated so that jets out of the boreholes nozzles 11*a-d* are angled at between 40°-50° from the longitudinal line 23 along the access well 20. The jets are jets of water in the shape of a single stream or a narrow cone. The boreholes 4 created by the borehole nozzles 11*a-d* branch off from the access well 20 at, at least 2, preferably 4, radial locations around the access well 20.

The boreholes 4 branch off from the access well 20 to access more of the underground methane source 3*a* or other proximal underground methane sources 3*b*. Therefore, advantageously, the boreholes 4 enable extraction of more methane from the methane source 3*a* or more methane from other proximal methane sources 3*b* without needing to drill multiple access wells 20.

Therefore, the apparatus or combination of operational equipment 1 is adapted to access a gas or liquid source from a large 3-dimensional volume underground without the use of multiple access wells or only with a single access port from the ground surface.

The apparatus further includes a diverter or deflector that is adapted to redirect, divert or deflect fluid jetted from the nozzle head at the angle.

The diverter includes an in-built rotation system.

The diverter forms part of a diverter system including a remote control facility. The diverter system may be adapted to allow for control at ground level or otherwise for remote control.

The diverter system includes sensors. The sensors facilitate responsively controlled jetting of the nozzle head.

The diverter system is adapted to change the angle of a jetting tubing exit. The angle may be between 0-90, more preferably 30-60, still more preferably 40-50, and ideally 45 degrees.

The jetting device include jetting tubing to effect the jet stream. The jetting tubing is in the form of capillaries. The jetting tubing includes stainless steel capillary tubing. The jetting device includes capillary tubing which is directed into the formation through the diverting device for a distance of 20 to 100 metres in segmented intervals in a 360 degree orientation from the horizontal wellbore. The jetting device operates at selected intervals along part of or an entire length of the horizontal wellbore.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

In the present specification, terms such as "apparatus", "means", "device" and "member" may refer to singular or plural items and are terms intended to refer to a set of properties, functions or characteristics performed by one or more items or components having one or more parts. It is envisaged that where an "apparatus", "means", "device" or "member" or similar term is described as being a unitary object, then a functionally equivalent object having multiple components is considered to fall within the scope of the term, and similarly, where an "apparatus", "assembly", "means", "device" or "member" is described as having multiple components, a functionally equivalent but unitary object is also considered to fall within the scope of the term, unless the contrary is expressly stated or the context requires otherwise. In the present specification, the phrase "and/or" refers to severally or any combination of the features. For example, the phrase "feature 1, feature 2 and/or feature 3" includes within its scope any one of the following combinations: Feature 1 or feature 2 or feature 3; feature 1 and feature 2 or feature 3; feature 1 or feature 2 and feature 3; feature 1 and feature 3 or feature 2; feature 1 and feature 2 and feature 3.

The meaning of descriptive, precise or absolute terms such as "flexed", "normal", "parallel", "horizontal", "vertical" or "fully" includes the preceding qualifier "substantially or almost", unless the context or contrary is expressly indicated.

Qualifying relative terms, such as "relatively", "sufficiently", "near", "almost" or "substantially", may be taken to indicate a variation in an absolute value of between 0° and 10° or between 0% and 10%, relative to the absolute value. For example, "near horizontal" may be taken to mean any orientation between 0° and 10° relative to the horizontal.

Where the word "for" is used to qualify a use or application of an object term, the word "for" is only limiting in the sense that the device or component should be "suitable for" that use or application.

In the present specification, the term "integral" means formed of one body in a single process. In particular, the term "integrally formed" means formed of the one body without post-forming attachment of separately formed component parts. That is, "integrally formed" and the similar term "unitarily formed" mean formed in a single forming process and do not include post-forming attachment of component parts by means of fastener or other component fixing substances or methods.

Orientational terms used in the specification and claims such as vertical, horizontal, top, bottom, upper and lower are to be interpreted as relational and are based on the premise that the component, item, article, apparatus, device or instrument will usually be considered in a particular orientation, which will usually be apparent from the context.

In the present specification, the term "integral" means formed of one body in a single process. In particular, the term "integrally formed" means formed of the one body without post-forming attachment of separately formed component parts. That is, "integrally formed" and the similar term "unitarily formed" mean formed in a single forming process and do not include post-forming attachment of component parts by means of fastener or other component fixing substances or methods.

The articles "a" and "an" are used herein to refer to one or to more than one (i.e. to at least one) of the grammatical object of the article. By way of example, "an element" means one element or more than one element.

It will be appreciated by those skilled in the art that many modifications and variations may be made to the methods of the invention described herein without departing from the spirit and scope of the invention. The features and components of each of the embodiments of the invention described in the detailed description and/or depicted in the accompanying drawings may be interchangeable as required, with regard to functional equivalency and compatibility. A feature or component described with reference to one but not all embodiments, if functionally and dimensionally compatible as an addition with another embodiment herein described, or substitutable with a corresponding feature or component of that other embodiment in relation to which it has not been expressly described, should be read as a potential addition or substitution to that other embodiment and as being within the scope of the invention. Furthermore, in considering a feature or component that is described in relation a particular embodiment but may be omitted from the embodiment without losing the functionality characterising the invention and without departing from the scope of the invention, unless the context and expressions used in describing the embodiment imputes that the feature or component is essential to the invention as broadly described, the omittable feature or component may be read as not being included in the embodiment.

The invention claimed is:

1. An apparatus for effecting liquid or gas communication to, from or between strata comprising at least one gas and/or liquid containing source, the at least one source having an upper boundary through which an access well is drilled whereby to extend the access well downwardly to a location within, below and/or above the at least one source, and to drill the access well laterally within, above and/or below the at least one source, the apparatus including a jetting device and a bore drill that is adapted to be inserted into the access well;

wherein:

the jetting device is adapted to form multiple boreholes extending from a lateral portion of the access well which multiple boreholes are in multiple substantially radial orientations around the lateral portion, without fracture stimulation of the strata;

the jetting device includes a nozzle head and a coil, the nozzle head having at least two borehole nozzles adapted to expel fluid provided by the coil, and propel the jetting device with coil forward out of the bore drill to form a borehole extending into the at least one source at an angle from the lateral portion, the jetting device adapted to change or maintain a direction that the jetting device is moving in; and the bore drill comprises a diverter where the diverter includes an in-built rotation system adapted to change the direction and angle of a jetting tubing exit of a jet in the bore drill by moving the bore drill rotationally with respect to the access well to change the angle of the jet.

2. The apparatus according to claim 1, wherein the multiple boreholes extend from the lateral portion of the access well in the multiple radial orientations at multiple longitudinal locations along the lateral portion of the access well.

3. The apparatus according to claim 1, wherein the coil is connected between components of the apparatus above a ground surface and the jetting device.

4. The apparatus according to claim 3, wherein the at least two borehole nozzles include one or more channel eroding nozzles adapted and orientated to jet water to erode channels and one or more propulsion nozzles adapted to propel the nozzle head along the access well.

5. The apparatus according to claim 1, wherein the coil acts as a spring and applies a force in a backwards direction along the access well towards a ground surface or an open end of the access well.

6. The apparatus as claimed in claim 1, wherein the jetting device includes ground-based components at the ground surface and the coil is adapted to provide tension between the nozzle head of the jetting device and the ground-based components.

7. The apparatus as claimed in claim 6, wherein the nozzle head is adapted to jet liquid or gas, to propel the jetting device forward and/or backwards along the access well relative to the forward-most end of the nozzle head, along, about or out from the access well.

8. The apparatus as claimed in claim 1, wherein the nozzle head is adapted to jet fluid at multiple angles from the nozzle head to form at least one channel at an angle between 30° and 60° relative to a longitudinal axis of the access well by a process of erosion.

9. The apparatus as claimed in claim 8, wherein the at least one channel includes multiple boreholes, and the nozzles are adapted and orientated to jet water to erode the surrounding material to form the multiple boreholes.

10. The apparatus of claim 1, wherein the bore drill further comprises batteries to power rotation of the diverter.

11. A drilling method for extracting coalbed methane (CBM) including deploying an apparatus including a jetting device and a bore drill, the apparatus adapted to effect fluid communication to, from or between strata comprising at least one gas and/or liquid containing source having a boundary, wherein the method steps include drilling an access well whereby to extend it to a location within, above and/or below the at least one source, wherein the method further includes:

drilling laterally within, above and/or below the at least one source to form a lateral portion of the access well to form multiple boreholes extending from the lateral portion which boreholes are in multiple substantially radial orientations around the lateral portion;

using a jetting device that has a nozzle head and a coil, the nozzle head having at least two borehole nozzles adapted to expel fluid provided by the coil and to propel the jetting device with coil forward out of the bore drill to form a borehole in the form of at least one channel extending outwardly from the lateral portion without fracture stimulation of the strata;

changing a direction that the jetting device is moving in by the use of a diverter forming part of the bore drill; and rotating the diverter, which comprises an in-built rotation system to change the direction and angle of a jetting tube exit of a jet in the bore drill by moving the bore drill rotationally with respect to the access well to change the angle of the jet.

12. The method as claimed in claim 11, wherein the boundary is an upper boundary that defines the extent of the source and a transition in phase or composition of solids, liquids or gases underground, and the source is a gas and/or liquid reservoir.

13. The method as claimed in claim 11, wherein the method includes drilling the access well using a bore drill, wherein the access well is between 10 m and 1000 m deep, and between 100 m and 15 km long in the lateral direction.

14. The method as claimed in claim 11, wherein the jetting device includes a connection in the form of a coil, tube or pipe, and the method includes extending the connection from a ground surface to a nozzle head of the jetting device.

* * * * *